US006425491B1

(12) United States Patent
Abraskin

(10) Patent No.: US 6,425,491 B1
(45) **Date of Patent: *Jul. 30, 2002**

(54) UNITARY CONSTRUCTION OF THREE BOTTLES FOR FINGERNAIL ADORNMENT FLUIDS

(76) Inventor: Gloria Abraskin, Four Sudbury Rd., Morganville, NJ (US) 07751

( * ) Notice: Subject to any disclaimer, the term of this patent is extended or adjusted under 35 U.S.C. 154(b) by 49 days.

This patent is subject to a terminal disclaimer.

(21) Appl. No.: 09/587,468

(22) Filed: Jun. 5, 2000

(51) Int. Cl.[7] ..... B65D 21/00
(52) U.S. Cl. ..... 215/10; 220/500
(58) Field of Search ..... 215/10, 6; 220/500, 220/503, 505, 509, 514, 524; D9/347, 521, 524; 401/129

(56) References Cited

U.S. PATENT DOCUMENTS

| | | | | | |
|---|---|---|---|---|---|
| 255,642 | A | * | 3/1882 | Lubin | 215/10 |
| 825,680 | A | * | 7/1906 | Raymond | 215/10 |
| D161,125 | S | * | 12/1950 | Polime | D44/22 |
| 2,767,830 | A | * | 10/1956 | Levy et al. | 220/23.2 |
| 4,165,812 | A | * | 8/1979 | Jennison | 215/10 |
| D263,118 | S | * | 2/1982 | Weckman | D9/341 |
| 4,919,293 | A | * | 4/1990 | Buckley | 220/23.2 |
| D326,606 | S | * | 6/1992 | Green | D9/341 |
| D420,576 | S | * | 2/2000 | Abraskin | D9/347 |

* cited by examiner

*Primary Examiner*—Lee Young
*Assistant Examiner*—Lien Ngo
(74) *Attorney, Agent, or Firm*—Myron Amer P.C.

(57) ABSTRACT

A unitary construction of three bottles containing fluids typically brushed onto fingernails in which the center bottle has opposite sides bounding a V-shaped bottom to promote gravity flow to a level facilitating brush removal of the fluid, and left and right bottles are respectively attached to the central bottle opposite sides to form a support which holds the unitary construction erect to achieve the gravity flow in the center bottle.

1 Claim, 1 Drawing Sheet

UNITARY CONSTRUCTION OF THREE BOTTLES FOR FINGERNAIL ADORNMENT FLUIDS

The present invention relates to improvements facilitating the grooming of fingernails, the improvements more particularly residing in a unitary bottle construction of the grooming fluids, namely the polish, nail hardener, and the like, all of which as generally known are characteristically somewhat viscous and, as such, have nominal flowability, but which characteristic is factored out of the grooming process by the unitary bottle construction, all as will be better understood as the description proceeds.

EXAMPLE OF THE PRIOR ART

It is already known that there is convenience when dealing with fluids typically supplied in bottles and/or plastic containers to integrate the bottles into a unitary construction, one such example of this known convenience being the "integral Dual Compartment Container" of U.S. Pat. No. 5,692,626 issued to Wehrle et al. on Dec. 2, 1997. The convenience of the '626 patent is the use of a single handgrip connected in spanning relation between two bottles connected back-to-back. Although there is a resulting convenience, it is of the nominal extent noted and in many instances does not warrant the expense of integrating the bottles, or of offsetting, as in the specific example discussed, the double weight of the unitary construction in the transport of the fluid that is involved, or in the handling of the awkwardness of the structure during the dispensing of the fluid.

Broadly, it is an object of the present invention to provide a unitary bottle construction overcoming the foregoing and other shortcomings of the prior art.

More particularly, it is an object to provide a unitary bottle construction in use of which the unitary construction significantly contributes to the use of the fluid contents, in this case the using gravity to facilitate flow to obviate the resistance to flow resulting from the viscous nature of the fingernail grooming fluids.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
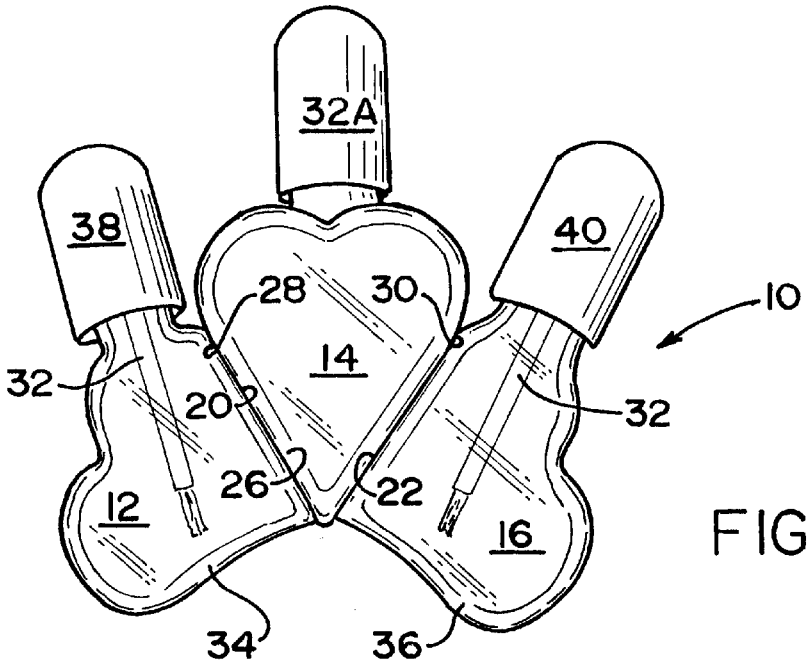
Figure 2:
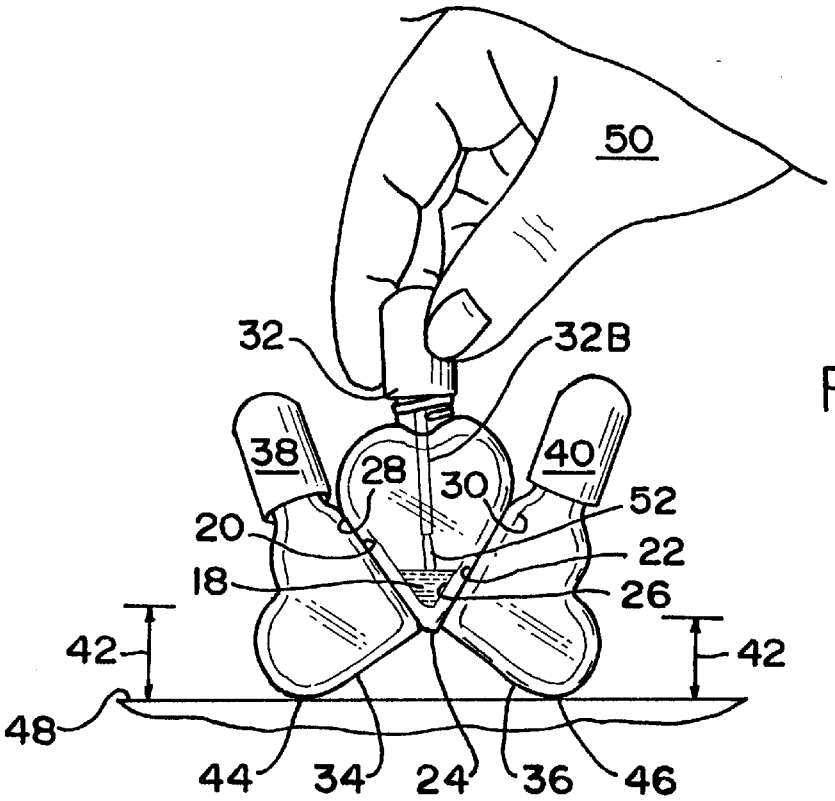

FIG. 1 is a front elevational view of a fingernail grooming integral three-bottle construction in accordance with the present invention; and FIG. 2 is a similar view but with the transparency of the center bottle depicted and illustrating the self-standing utility thereof.

It is known by common experience that in a fingernail grooming salon a manicurist and/or other salon employee will apply polish to a patron's fingernails, one hand at a time, during which although a patron's hand is placed flat on a table or other support surface, nevertheless the manicurist will steady the hand in a grasp and using the other hand alternately dip and remove a brush applicator into and out of a bottle of fingernail polish, incident to grooming the fingernails with polish. At home, the essentials of the salon grooming procedure is followed except, of course, without the assistance of the manicurist.

In either circumstance, care must be taken to avoid tipping over the bottle with the polish left open to allow use of the brush applicator. Also, as the source of polish is used, the remainder at the flat bottom of a prior art bottle is difficult to remove with the brush end of the applicator.

Overcoming the foregoing and other shortcomings of the prior art, use is made of a unitary construction, generally designated 10, consisting of three bottles 12, 14 and 16 cooperatively serving as supply sources of liquids typically brushed onto fingernails, such as nail hardener, clear lacquer and, most important in the grooming of fingernails, a polish of a selected color. Bottle 14 chosen as the repository of the fingernail polish 18 has an operative vertically oriented position centrally of the unitary construction 10. Bottle 14 also has, as a result of the embodiment of left and right angularly oriented sides 20 and 22 in converging relation to each other to a point of convergence which serves as a bottom 24 of the bottle 14, the utility that the sides 20 and 22 bound a V-shape compartment 26 as the bottle bottom 24 which promotes gravity flow into the bottom 24.

The second left side and third right side bottles 12 and 16 are each imparted with angularly oriented inboard sides 28 and 30 at the same angles subtended by the angles of the center bottle sides 20 and 22, so that angular orientation of these sides match each other to contribute to the fusing together of the glass construction material of the bottles 12, 14 and 16 to each other at the interface of the surfaces of the sides 20, 22, 28, and 30.

In longitudinal depending relation from a brush applicator 32 in bottle 12 and a brush applicator 32 in bottle 16, are respectively the bottle sides 34 and 36, such that functionally these sides serve as the bottle bottoms during the dipping into and removal of the nail hardener and clear lacquer of brush applicators (not shown) depending from the bottle caps 38 and 40, similar to the shown cap 32A and brush applicator 32B of the fingernail polish bottle 14.

The bottoms 34 and 36 extend a selected equal distance 42 beyond the point of convergence 24 so that sites of contact 44 and 46 are used to advantage to position the unitary construction 10 on a flat support surface 48. Thus, the unitary construction 10 on a flat support surface 48 has a hands-off self-standing orientation during the dipping into and removal of the brush applicator 32A being handled, as at 50, by the manicurist.

Additionally, the vertical orientation of the center bottle 14 contributes to gravity flow of the polish 18 into the V-shape compartment 26 in which the configuration of the V-shape raises the level of the remainder of the polish facilitating its removal by the brush end 52 of the applicator 32A.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A unitary construction of three bottles serving as supply sources of liquids which may be brushed onto fingernails comprising a first bottle having an operative position centrally of said unitary construction characterized by left and right angularly oriented sides in converging relation to each other to a point of convergence at a bottom of said bottle, said left and right sides bounding therebetween a V-shape compartment at said bottle bottom, and a second left side bottle and a third right side bottle each characterized by an angularly oriented side in matching relation to the angularly oriented sides of said first bottle and each having a bottom in extending relation beyond said bottle angularly oriented sides, and said second left side bottle and said third right side bottle having operative positions in attached relation to the left and right of said first bottle along said matching angularly oriented sides of said first, second and third bottles, whereby in a supported position of said bottoms of said second and third bottles on a support surface said first bottle is in a vertical orientation to contribute to gravity flow of liquid into said V-shape compartment thereof to thereby facilitate brush removal of liquid from said compartment.

* * * * *